US010643777B2

(12) United States Patent
Nogués Barrieras et al.

(10) Patent No.: US 10,643,777 B2
(45) Date of Patent: May 5, 2020

(54) COOLING ARRANGEMENT

(71) Applicant: ABB SCHWEIZ AG, Baden (CH)

(72) Inventors: Antonio Nogués Barrieras, Sarinñena (ES); Carlos Roy Martín, Saragossa (ES); Luis Sánchez, Vigo (ES); Rafael Murillo, Saragossa (ES); Lorena Cebrián Lles, Saragossa (ES); Carlos Mainar Joven, Saragossa (ES)

(73) Assignee: ABB SCHWEIZ AG, Baden (CH)

( * ) Notice: Subject to any disclaimer, the term of this patent is extended or adjusted under 35 U.S.C. 154(b) by 195 days.

(21) Appl. No.: 15/617,916

(22) Filed: Jun. 8, 2017

(65) Prior Publication Data

US 2017/0358390 A1 Dec. 14, 2017

(30) Foreign Application Priority Data

Jun. 10, 2016 (EP) ..... 16173947

(51) Int. Cl.

| | |
|---|---|
| ***H01F 27/20*** | (2006.01) |
| ***H01F 27/36*** | (2006.01) |
| ***H01F 27/08*** | (2006.01) |
| ***H01F 27/28*** | (2006.01) |

(52) U.S. Cl.

CPC ..... *H01F 27/20* (2013.01); *H01F 27/085* (2013.01); *H01F 27/2885* (2013.01); *H01F 27/362* (2013.01)

(58) Field of Classification Search

CPC ..... H01F 27/00–36
USPC ..... 336/55–62, 178, 212–215, 233–234
See application file for complete search history.

(56) References Cited

U.S. PATENT DOCUMENTS 2,942,213 A * 6/1960 Camilli ..... H01F 27/20 165/104.33
3,376,531 A * 4/1968 Fischer ..... H01F 27/324 174/357
4,663,603 A * 5/1987 van Riemsdijk ..... H01F 27/324 174/DIG. 25
4,725,804 A 2/1988 Yarpezeshkan
4,977,301 A * 12/1990 Maehara ..... H01F 27/36 174/393

(Continued)

FOREIGN PATENT DOCUMENTS

CA 2 495 382 3/2004
DE 10238521 A1 3/2004

(Continued)

OTHER PUBLICATIONS

Extended European Search Report dated Dec. 6, 2016 for EP Appln No. 16173947.9, 6 pages.

*Primary Examiner* — Tuyen T Nguyen
(74) *Attorney, Agent, or Firm* — Squire Patton Boggs (US) LLP

(57) ABSTRACT

A cooling arrangement for a dry-type transformer. The arrangement includes blowing equipment configured to blow a gas flow, and an opening positionable in a clamping structure of the transformer. The opening is configured to allow the gas flow to pass from the blowing equipment towards a winding of the transformer, so that the winding is properly cooled. The opening comprises an electric protecting means for dielectric protection of the clamping structure. A transformer including such cooling arrangement is also disclosed.

14 Claims, 3 Drawing Sheets

(56) References Cited

U.S. PATENT DOCUMENTS

| | | | | |
|---|---|---|---|---|
| 2013/0113598 | A1* | 5/2013 | Murillo | H01F 27/2885<br>336/84 C |
| 2015/0109090 | A1* | 4/2015 | Patel | H01F 27/362<br>336/84 C |

FOREIGN PATENT DOCUMENTS

| | | | | |
|---|---|---|---|---|
| EP | 2430643 | B1 * | 9/2012 | H01F 27/26 |
| EP | 2430643 | B1 | 9/2012 | |

* cited by examiner

COOLING ARRANGEMENT

PRIORITY CLAIM

This application claims priority to EP 16173947.9, filed Jun. 10, 2016, the entire contents of which are hereby incorporated by reference for all purposes.

FIELD OF INVENTION

The present disclosure relates to cooling for dry-type transformers. In particular, the invention relates to a cooling arrangement for refrigerating at least a winding of a transformer and a transformer comprising the arrangement.

BACKGROUND

Transformers may be widely used for low, medium and high voltage applications.

It is widely known that the transformers may suffer from temperature raises during operation. These temperature issues have to be avoided or even reduced as low as possible in order to achieve a better performance and a long life.

A particular type of transformers is a dry-type transformer which may use a gas such as air to refrigerate for instance the winding or coils thereof. This air cooling may be forced or natural. In case of forced-air cooling the blowing equipment may be positioned to blow the airflow to the winding.

It is also known the use of electric shielding devices for protecting the clamping structure of the transformer from electric fields generated by the winding. An example of such an electric shielding device is disclosed in EP2430643B1. The transformer comprises windings and clamps linked to yokes for supporting the whole transformer. The electric shielding arrangement is arranged between the clamp and the winding.

For dry-type transformers with air-forced (AF) refrigeration, the protective sheet or electric shielding device which covers the clamps of the transformer may block the airflow that is directed to the winding, particularly to an inner zone of the winding arrangement. This inner zone of the winding may correspond for instance to a lower level voltage portion of the transformer and the outer zone may correspond for instance to a higher level voltage portion of the transformer. Depending on the case the outer zone may receive the cooling airflow barely without obstacle despite of the shielding device. However, the inner zone which is surrounded by the outer zone and the shielding device may not receive an adequate flow rate for keeping the temperatures at a desired level.

It has now been found that it is possible to provide an improved cooling arrangement for dry-type transformers provided with electric shielding devices, which allows to properly refrigerate the winding and may be more efficient than known solutions.

SUMMARY

In a first aspect, a cooling arrangement for a dry-type transformer is provided. The arrangement may comprise:

a blowing equipment configured to blow at least one gas flow;

at least one opening positionable at least partially in a clamping structure of the transformer;

the opening being configured to allow the gas flow to pass from the blowing equipment towards at least one winding of the transformer;

the opening comprising an electric protecting means.

The provision of a cooling arrangement which may comprise an opening positionable at least partially in the clamping structure and the blowing equipment allows reducing as low as possible the temperature raises caused in the winding when the transformer is in operation. Therefore the performance and the lifespan of the transformer are improved.

The at least one opening clears the way or path followed by the gas flow from the blowing equipment to the winding.

The opening of the present cooling arrangement comprising an electric protecting means also keeps the electric shielding for the clamping structure of the transformers and therefore the clamping structure of the transformer is prevented from electric fields generated between the operating winding and the clamping structure.

In some examples of the cooling arrangement for dry-type transformers, the transformer may comprise an inner winding surrounding at least partially a core and an outer winding surrounding at least partially the core, the inner winding being placed at least partially between the core and the outer winding, wherein the at least one opening may be configured to allow the gas flow to pass from the blowing equipment towards the inner winding. Owing to the present solution the inner winding may be maintained at an optimal temperature since receives an adequate cooling gas flow from the blowing equipment. The performance and the lifespan of the transformer are further improved.

In a further aspect the present invention provides for a transformer which may comprise a cooling arrangement as described.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
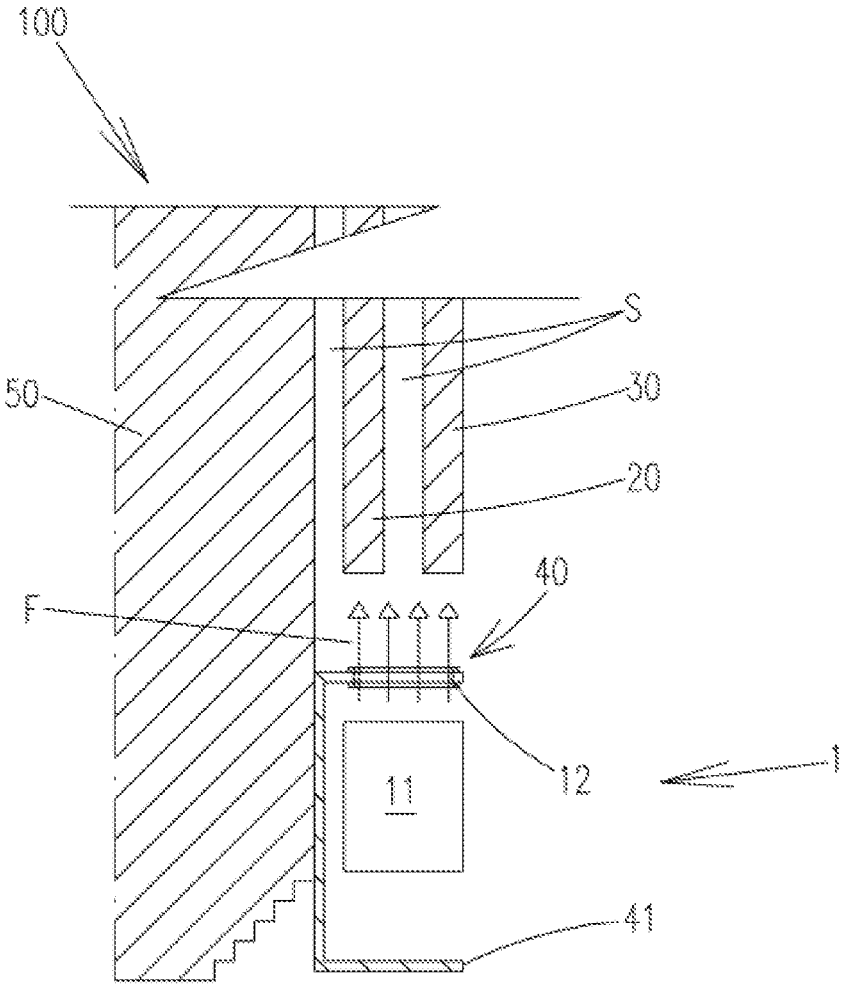
FIG. 1 is a schematic partial and sectional view of a transformer comprising a cooling arrangement according to the present invention.

In FIG. 1 it is shown a partial section of a dry-type transformer 100 which comprises a cooling arrangement 1 according to the present invention. The transformer 100 may be one of a high voltage HV/low voltage LV type but any other voltage level could be used. In the present example the rated power may be in the range of 0.1-100 MVA and the low voltage may be in the range of 0.1-400 kV.

Figure 2:
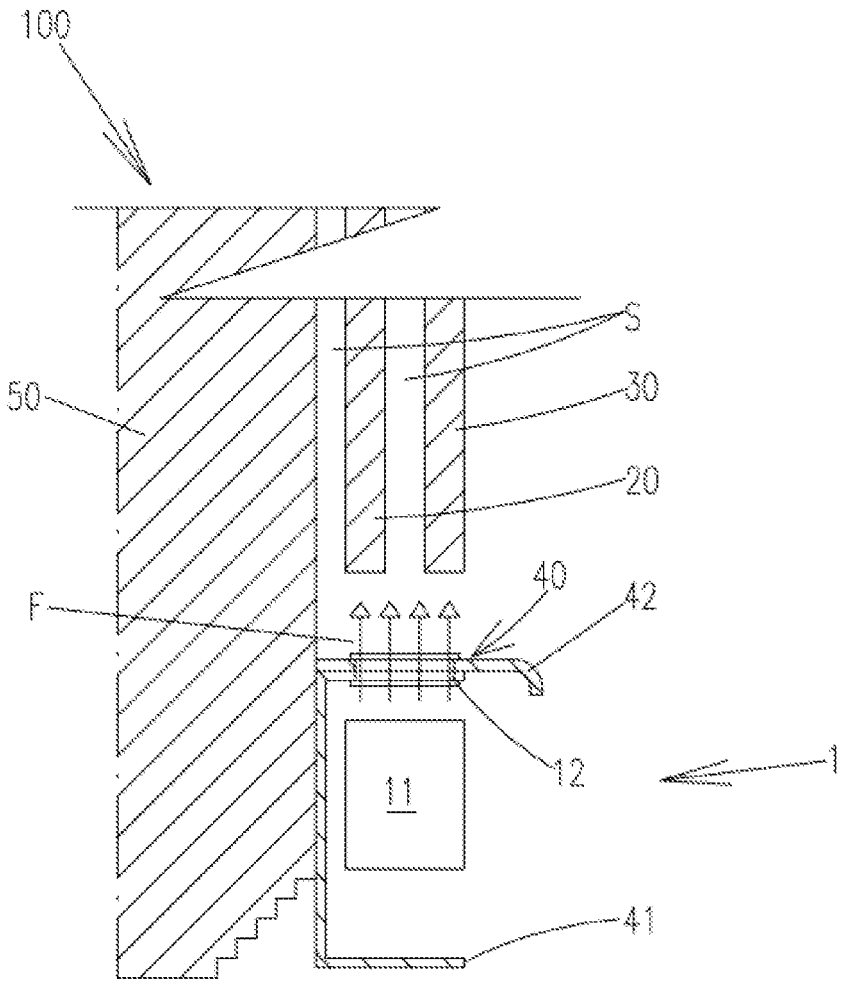
FIG. 2 is a schematic partial and sectional view of the transformer of FIG. 1 with an electric shielding device and comprising the cooling arrangement of the present invention.

As can be seen in FIGS. 1-2 the present transformer 100 may comprise an inner winding 20 of LV surrounding a core 50 and an outer winding 30 of HV surrounding the core 50, the inner winding 20 may be placed at least partially between the core 50 and the outer winding 30. An exemplary transformer 100 could be a dry-type transformer "HiDry" by ABB. Therefore the use of "inner" and "outer" may be related to the location of the core 50.

The transformer 100 may be provided with a clamping structure 40 which may comprise at least a clamp 41 and additionally an electric shielding device 42. The clamp 41 may have a U-profile or may have a form of a bended plate and may be manufactured for instance with carbon steel. The electric shielding device 42 may comprise a protective sheet and may be positionable between the winding 20, 30 and the clamp 41. This electric shielding device 42 may be configured for shielding the clamp 41 from an electric field of the winding 20, 30.

The electric shielding device 42 may comprise a material chosen from the group which comprise steel and aluminium but generally any conducting material with suitable mechanical properties.

As per FIGS. 1-2 the present cooling arrangement 1 may comprise:

a blowing equipment 11 configured to blow at least one gas flow F. The gas may be air or any other suitable cooling gas;

at least one opening 12 which may be positionable in a clamping structure 40 of the transformer 100;

the opening 12 may be configured to allow the gas flow F to pass from the blowing equipment 11 towards at least one winding 20, 30 of the transformer 100; and the opening 12 may comprise an electric protecting means 14.

The blowing equipment 11 may comprise at least one fan which has for instance a flow rate between 250 $m^3/h$ and 5000 $m^3/h$ and may be a centrifugal-type fan. Those flow rates and type may be modified depending on the requirements of each case. In FIGS. 1-2 only one fan has been illustrated for both windings 20, 30 but in alternative examples the blowing equipment 11 may comprise at least one fan adapted to direct the gas flow F to the inner winding 20 and at least one fan adapted to direct the gas flow F to the outer winding 30.

In further alternative examples at least one fan may be adapted to direct the gas flow F to the inner winding 20 through the opening 12 and an additional fan may be adapted to direct the gas flow F to the outer winding 30 out of the opening 12.

In FIG. 1 a sectional view of a transformer 100 with the clamping structure 40 void of electric shielding device 42 is shown. The clamping structure 40 may comprise the clamp 41 without electric shielding device 42. In this case the opening 12 may be positioned in the clamp 41. The opening 12 may be positioned at least partially in the clamp 41.

In FIG. 2 the clamping structure 40 further comprises at least one electric shielding device 42 positionable between the clamp 41 and the winding 20, 30, and the opening 12 may be positionable in the electric shielding device 42 and the clamp 41 or only in the electric shielding device 42. It can be seen in FIG. 2 that the both the electric shielding device 42 and the clamp 41 may be provided with corresponding openings 12 wherein the openings 12 may substantially match each other. However, the openings 12 may match partially each other. In any case the opening 12 may be positioned in order to allow the gas flow F to pass from the blowing equipment 11 to the windings 20, 30.

Figure 3:
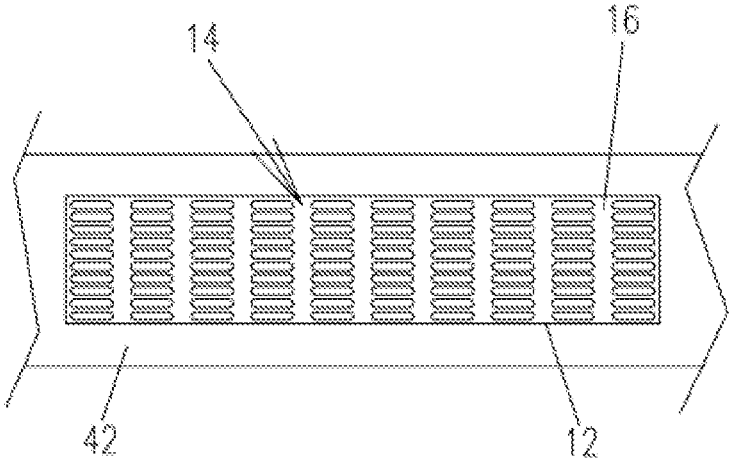
FIG. 3 is a schematic partial and plan view of a first embodiment of the present invention.

FIG. 3 shows a plan view of a first embodiment of the present cooling arrangement 1, wherein the electric protecting means 14 may comprise a slotted portion 16, the slotted portion 16 being configured to define a plurality of holes. The plurality of holes of the slotted portion 16 may be shaped in any suitable form such as a square, circle, rectangle, triangle, oval, etc.

Figure 4:
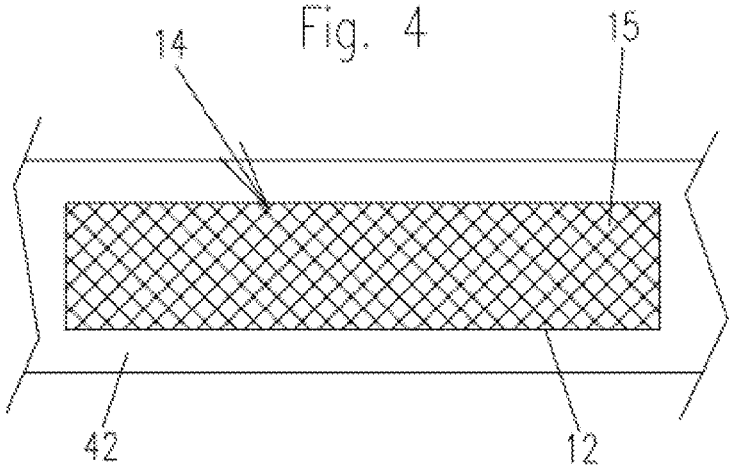
FIG. 4 is a schematic partial and plan view of a second embodiment of the present invention.

FIG. 4 shows a plan view of a second embodiment of the present cooling arrangement 1, wherein the electric protecting means 14 may comprise a grid 15, the grid 15 being configured to define a plurality of holes. The plurality of holes of the grid 15 may be shaped in any suitable form such as a square, circle, rectangle, triangle, oval, etc.

Alternatively the electric protecting means 14 may be integrally formed (not shown) with the clamping structure 40. This may be the case for instance wherein a plurality of drills, bores or the like are produced in the electric shielding device 42 or the clamp 41. Therefore the grid 15 and/or the slotted portion 16 may be configured either as a separate or integral part from/of the clamping structure 40.

Both the slotted portion 16 and the grid 15 may be adapted for orienting and/or distributing the gas flow F as desired.

As can be seen in FIGS. 1-2 the blowing equipment 11 may be configured in such a way that the outlet of the fan may be directed to the inner and/or the outer winding 20, 30. The gas flow F may reach at least a portion of the surface of the winding 20, 30 taking advantage of the opening 12. The gas flow F may be made to run through interstice spaces S provided between the windings 20, 30 each other and/or between a winding 20 and the core 50. A convective heat transfer may be caused by running the gas flow F over at least a surface portion of the windings 20, 30. The windings 20, 30 may be warmed up in operation and may transfer heat to the relative cooler gas flow F over the surface portions of the windings 20, 30. The windings 20, 30 may be kept at a proper temperature by the heat transfer to the gas flow F.

Owing to the opening 12 the relative cooler gas flow F may reach surface portions of the windings 20, 30 oriented for instance to the interstice spaces S or gaps. Once the gas flow F has run over the surface of the winding 20, 30 (through the interstice spaces S) may be warmed because the relative hotter winding 20, 30 has given heat to the gas flow F. The warm up of the gas flow F may be achieved in a progressive way along the interstices spaces S.

The relative positioning of the outlet of the blowing equipment 11 to windings 20, 30 may be chosen so that the winding-directed gas flow F may run over the surface of the winding 20, 30. An example may be positioning the blowing equipment 11 at the bottom of the transformer 100, near the clamping structure 40. Other alternatives may be chosen by the skilled person for positioning the blowing equipment 11 relative to the transformer 100.

If the blowing equipment 11 comprises more than one fan the outlet of a second one may be directed to an outer surface of the outer winding 30 for instance.

Several tests were carried out on the present cooling arrangement for dry-type transformers. Air speed, thermal and dielectric measurements were performed. Those tests confirmed that the present invention may provide for a significant uprating of the cooling power and at the same time no dielectric issue may be created.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow. If reference signs related to drawings are placed in parentheses in a claim, they are solely for attempting to increase the intelligibility of the claim, and shall not be construed as limiting the scope of the claim.

The invention claimed is:

1. A cooling arrangement for a dry-type transformer, the arrangement comprising:

blowing equipment configured to blow at least one gas flow;

at least one opening positioned at least partially in a clamping structure of the transformer;

the opening being configured to allow the gas flow to pass from the blowing equipment towards at least one winding of the transformer;

the clamping structure comprises a clamp and an electric shielding device positioned between the clamp and the winding;

the opening comprising an electric protector.

2. The cooling arrangement according to claim 1, wherein the clamping structure comprises at least one clamp and the opening is positioned at least partially in the clamp.

3. The cooling arrangement according to claim 2, wherein the clamping structure further comprises at least one electric shielding device positioned between the clamp and the winding, and the opening is positioned at least partially in the electric shielding device and the clamp.

4. The cooling arrangement according to claim 1, wherein the electric protector comprises a grid that defines a plurality of holes.

5. The cooling arrangement according to claim 1, wherein the electric protector comprises a slotted portion that defines a plurality of holes.

6. The cooling arrangement according to claim 1, wherein the electric protector is integrally formed with the clamping structure.

7. The cooling arrangement according to claim 1, wherein the blowing equipment has a flow rate of at least 250 $m^3/h$.

8. The cooling arrangement according to claim 1, wherein the transformer comprises an inner winding surrounding at least partially a core and an outer winding surrounding at least partially the core, the inner winding being placed at least partially between the core and the outer winding, wherein the one opening is configured to allow the gas flow to pass from the blowing equipment towards the inner winding.

9. The cooling arrangement according to claim 1, wherein the blowing equipment comprises at least one fan.

10. The cooling arrangement according to claim 8, wherein the blowing equipment comprises at least one fan adapted to direct the gas flow to the inner winding and at least one fan adapted to direct the gas flow to the outer winding.

11. The cooling arrangement according to claim 3, wherein the electric shielding device comprises a protective sheet.

12. The cooling arrangement according to claim 1, wherein the gas is air.

13. A transformer comprising a cooling arrangement according to claim 1.

14. A cooling arrangement for a dry-type transformer, the arrangement comprising:

blowing equipment to blow at least one gas flow;

an opening to allow the gas flow to pass from the blowing equipment towards at least one winding of the transformer, wherein the opening is positionable in an electric shielding device provided between at least one clamp of the transformer and the winding, and wherein the opening comprises an electric protector.

* * * * *